US007641418B2

(12) United States Patent
Hall et al.

(10) Patent No.: US 7,641,418 B2
(45) Date of Patent: Jan. 5, 2010

(54) METHOD FOR DEPOSITING PAVEMENT REJUVENATION MATERIAL INTO A LAYER OF AGGREGATE

(76) Inventors: David R. Hall, 2185 S. Larsen Pkwy., Provo, UT (US) 84606; Timothy C. Duke, 2185 S. Larsen Pkwy., Provo, UT (US) 84606; Cordin Daranga, 2185 S. Larsen Pkwy., Provo, UT (US) 84606; David Wahiquist, 2185 S. Larsen Pkwy., Provo, UT (US) 84606

( * ) Notice: Subject to any disclaimer, the term of this patent is extended or adjusted under 35 U.S.C. 154(b) by 642 days.

(21) Appl. No.: 11/379,643

(22) Filed: Apr. 21, 2006

(65) Prior Publication Data

US 2006/0198698 A1 Sep. 7, 2006

Related U.S. Application Data

(63) Continuation-in-part of application No. 11/164,947, filed on Dec. 12, 2005, which is a continuation-in-part of application No. 11/163,615, filed on Oct. 25, 2005, now Pat. No. 7,473,052, which is a continuation-in-part of application No. 11/070,411, filed on Mar. 1, 2005, now Pat. No. 7,223,049.

(51) Int. Cl.
*E01C 7/22* (2006.01)

(52) U.S. Cl. ..... 404/75; 404/72; 404/94; 404/96

(58) Field of Classification Search ..... 404/72–82, 404/90–96, 101, 107–11, 117, 118, 122, 404/128
See application file for complete search history.

(56) References Cited

U.S. PATENT DOCUMENTS 3,361,042 A 1/1968 Cutler
3,732,023 A 5/1973 Rank
3,970,404 A 7/1976 Benedetti
3,989,401 A 11/1976 Moench
4,018,540 A 4/1977 Jackson
4,104,736 A 8/1978 Mendenhall
4,124,325 A 11/1978 Cutler
4,172,679 A 10/1979 Wirtgen
4,195,946 A 4/1980 Swisher
4,335,975 A 6/1982 Schoelkopf
4,347,016 A 8/1982 Sindelar
4,407,605 A 10/1983 Wirtgen
4,453,856 A 6/1984 Chiostri
4,473,320 A 9/1984 Register
4,534,674 A 8/1985 Cutler
4,594,022 A 6/1986 Jeppson
4,668,017 A 5/1987 Petersen
4,676,689 A 6/1987 Yant
4,692,350 A * 9/1987 Clarke et al. ..... 427/138
4,784,518 A 11/1988 Cutler (Continued)

*Primary Examiner*—Raymond W Addie
(74) *Attorney, Agent, or Firm*—Tyson J. Wilde

(57) ABSTRACT

In one aspect of the invention a method includes the steps of providing a channel attached to a vehicle adapted to transverse an area, the channel being in communication with at least one supply of pavement rejuvenation material, and the area having a layer of pavement aggregate; positioning the channel so that at least a portion of the channel is disposed within the layer; and adding the pavement rejuvenation material into the layer from an opening in the channel positioned below the surface of the layer.

22 Claims, 11 Drawing Sheets

U.S. PATENT DOCUMENTS 4,793,730 A 12/1988 Butch
4,968,101 A 11/1990 Bossow
5,366,320 A 11/1994 Hanlon
5,486,554 A * 1/1996 Truax ..... 524/71
5,556,225 A 9/1996 Marino
5,584,597 A * 12/1996 Lemelson ..... 404/83
5,765,926 A 6/1998 Knapp
5,791,814 A 8/1998 Wiley
5,957,621 A * 9/1999 Clark et al. ..... 404/111
6,158,920 A 12/2000 Malot
6,371,689 B1 4/2002 Wiley
6,623,207 B2 9/2003 Grubba
6,769,836 B2 8/2004 Lloyd
6,918,714 B2 * 7/2005 Chambard ..... 404/82
2003/0181557 A1 * 9/2003 Suzuki et al. ..... 524/334

* cited by examiner

METHOD FOR DEPOSITING PAVEMENT REJUVENATION MATERIAL INTO A LAYER OF AGGREGATE

CROSS REFERENCE TO RELATED APPLICATIONS

This application is a continuation-in-part of U.S. patent application Ser. No. 11/164,947 which was filed on Dec. 12, 2005 and entitled Apparatus for Depositing Pavement Rejuvenation Materials on a Road Surface. U.S. patent application Ser. No. 11/164,947 is a continuation-in-part of U.S. patent application Ser. No. 11/163,615 filed on Oct. 25, 2005 now U.S. Pat. No. 7,473,052 and entitled Apparatus, System, and Method for In Situ Pavement Recycling. U.S. patent application Ser. No. 11/163,615 is a continuation-in-part of U.S. patent application Ser. No. 11/070,411 filed on Mar. 1, 2005 now U.S. Pat. No. 7,223,049 and entitled Apparatus, System, and Method for Directional Degradation of a Paved Surface All of the above mentioned U.S. Patent Applications are herein incorporated by reference for all that they contain.

BACKGROUND OF THE INVENTION

The present invention relates to road reconstruction equipment and, more particularly, to a method for depositing pavement rejuvenation materials on a roadway. Since their debut in the late 1960s and early 1970s, asphalt milling machines have been considered one of the major innovations in road reconstruction. Asphalt milling machines were originally designed to remove a top layer of deteriorated asphalt so a new layer of asphalt could be overlaid on the exposed underlayer. The resulting pavement was superior to simply overlaying a new layer of asphalt directly onto the old and deteriorated asphalt.

One significant benefit of asphalt milling machines that has emerged modernly is the ability to break up asphalt into recyclable-sized fragments. As recycling of all types has become more popular, asphalt milling machines have similarly increased in popularity. In fact, combination milling and paving machines have been developed to mill or break up the old road surface, mix it with new binder, and lay it down to create a new or recycled road surface in one continuous process.

The core component of most modern asphalt milling machines is the cutting drum. Most cutting drums incorporate numerous cutting teeth, coupled to the rounded surface of the drum, to cut or tear into the road surface. The rotational axis of the drum is positioned parallel to the road surface and the drum is rotated while being driven along the road surface in a direction transverse to its axis of rotation. Conventional cutting drums mill the asphalt in an upward direction, or an "up-cut" direction. However, some cutting drums may permit "down-cutting" to control "slabbing," facilitate pulverizing and mixing, and effectively mill pavement over a wet base. Most cutting drums range in width from 12 to 150 inches and generally have a maximum cutting depth of 4 to 16 inches.

Due to the abrasive nature of pavement, the cutting teeth traditionally wear out quickly and require frequent replacement. The replacement process may create significant downtime and hinder the overall efficiency of the milling process. For example, early cutting drums had cutting teeth that were welded to the drum. Tooth replacement required cutting the old teeth from the drum and welding new teeth in their place. Consequently, considerable effort has been expended to accelerate the replacement process and to increase the durability of the cutting teeth. Many newer cutting teeth, for example, are coupled to the cutting drum using various bolt-on housings to enable faster replacement.

One shortcoming of current asphalt milling machines is their failure to capitalize on cutting-edge technology used in other industries, such as the downhole drilling industry. For example, numerous technological improvements in polycrystalline diamond compact (PDC) bits, which were introduced to the oil and gas industry in the mid 1970s, have enabled PCD bits to capture a growing share of the downhole drill bit market. Some estimates show that between 2000 and 2003, the total footage drilled with PDC bits increased from 26% in 2000 to 50% in 2003. The total revenue generated by PDC bit sales was approximately $600 million in 2003.

Various recent improvements in PDC bit hydraulics, PDC cutter toughness and abrasion-resistance, and PDC bit dynamic stability have resulted in continuous and significant increases in the average rate of penetration (ROP) and bit life of PDC bits, thereby extending the application of PDC bits into harder and more abrasive formations. In some cases, a single PDC bit may drill 20,000 feet or more without replacement. As a result, a PCD bit may save as much as $1 million per well in time-critical drilling applications. It would be a significant advance if drill bit improvements in the downhole drilling industry could be applied to the road reconstruction industry, where downtime and replacement costs incur significant expense.

Accordingly, what are needed are apparatus and methods for incorporating drill bit and other advances of the downhole drilling industry into road reconstruction equipment. More particularly, apparatus and methods are needed to incorporate PCD and other drill bit advances into asphalt milling, grinding, and recycling equipment. Further needed are novel supplemental and auxiliary systems, such as apparatus for depositing new or recycled pavement rejuvenation materials on a roadway, to work in conjunction such apparatus and methods, to facilitate the removal and recycling of asphalt and other pavement materials.

BRIEF SUMMARY OF THE INVENTION

In one aspect of the invention a method includes the steps of forming a layer of pavement aggregate by degrading pavement with a plurality of degradation elements attached to an underside of a vehicle and adapted to independent movement of each other; providing a channel attached to a vehicle adapted to traverse an area comprising a layer of pavement aggregate, the channel being in communication with at least one supply of pavement rejuvenation material; positioning the channel so that at least a portion of the channel is disposed within the layer; and adding the pavement rejuvenation material into the layer from an opening in the channel positioned below the surface of the layer. In certain embodiments, the channel may comprise a trough, trench, tubing, hose, chamber, pipe, pressurized pathway, a funnel, chute, conduit, or combinations thereof.

The method may further include the step of mixing at least some pavement rejuvenation material from the at least one supply with at least some pavement rejuvenation material from a second supply of pavement rejuvenation material to form a resultant rejuvenation material, which may foam under atmospheric pressure. The mixing of the pavement rejuvenation materials may occur under a pressure high enough to keep the resultant rejuvenation material from foaming. In embodiments where the mixing takes place within the channel under a high pressure, the resultant material may foam as it exits the opening in the channel. It is believed foaming the rejuvenation materials will be beneficial in recycling paved surfaces since the foaming action may spread the rejuvenation material through the layer. Timing may be important since the rate of foaming may decrease rapidly. By keeping the step of mixing the pavement rejuvenation materials under high pressure, foaming may be delayed until the instant that it is desired, thus allowing the foamed resultant material to spread into as much aggregate as possible. In some embodiments, zeolite may be incorporated in the rejuvenation material, which may help control the rate of foaming. In some embodiments a foaming half-life is between 5-60 seconds. A more preferred foaming half-life is 20 seconds or more.

Preferably, the second supply of pavement rejuvenation material is water, which mixes with an oil-based rejuvenation material, such as bitumen. In some embodiments, the second supply is air, another gas, another liquid, or combinations thereof. The temperature of both supplies of rejuvenation material may vary, but preferably both supplies are hot. In some embodiments, it may be desirable for the second supply of rejuvenation materials to be cool. Heat sources may be placed within or adjacent the channel to heat either supply of rejuvenation material. In other embodiments the rejuvenation material(s) may be heated prior to entering the channel.

In some embodiments, it may be desirable to have a sprayer attached to the vehicle which is adapted to spray rejuvenation material into the surface of the layer. This may increase the surface energy of aggregate coated with the rejuvenation material. In some embodiments the sprayed rejuvenation material under goes a foaming process similar to the rejuvenation material traveling through the channel, although the sprayed material may or may not be foamed. The channels may be adapted to vibrate, rotate, shake, move, or oscillate which may help spread rejuvenation material throughout the layer.

In some embodiments the opening of the channel is protected by a superhard material. This may be beneficial in embodiments where the channel contacts a second layer underneath the layer of aggregate. Preferably, the rejuvenation material is deposited on the second layer and foams up into the layer of pavement aggregate. Since the rejuvenation material is deposited on the second layer it will bond the two layers together.

DETAILED DESCRIPTION OF THE INVENTION AND THE PREFERRED EMBODIMENT

Reference throughout this specification to "one embodiment," "an embodiment," or similar language means that a particular feature, structure, or characteristic described in connection with the embodiment is included in at least one embodiment in accordance with the present invention. Thus, use of the phrases "in one embodiment," "in an embodiment," and similar language throughout this specification may, but does not necessarily, all refer to the same embodiment.

Furthermore, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

In the following description, numerous specific details are disclosed to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

In this application, "pavement" or "paved surface" refers to any artificial, wear-resistant surface that facilitates vehicular, pedestrian, or other form of traffic. Pavement may include composites containing oil, tar, tarmac, macadam, tarmacadam, asphalt, asphaltum, pitch, bitumen, minerals, rocks, pebbles, gravel, polymeric materials, sand, polyester fibers, Portland cement, petrochemical binders, or the like. Likewise, rejuvenation materials refer to any of various binders, oils, and resins, including bitumen, surfactant, polymeric materials, emulsions, asphalt, tar, cement, oil, pitch, maltenes, zeolite, wax, or the like. Reference to aggregates refers to rock, crushed rock, gravel, sand, slag, soil, cinders, minerals, or other course materials, and may include both new aggregates and aggregates reclaimed from an existing roadway. Likewise, the term "degrade" or "degradation" is used in this application to mean milling, grinding, cutting, ripping apart, tearing apart, or otherwise taking or pulling apart a pavement material into smaller constituent pieces.

Figure 1:
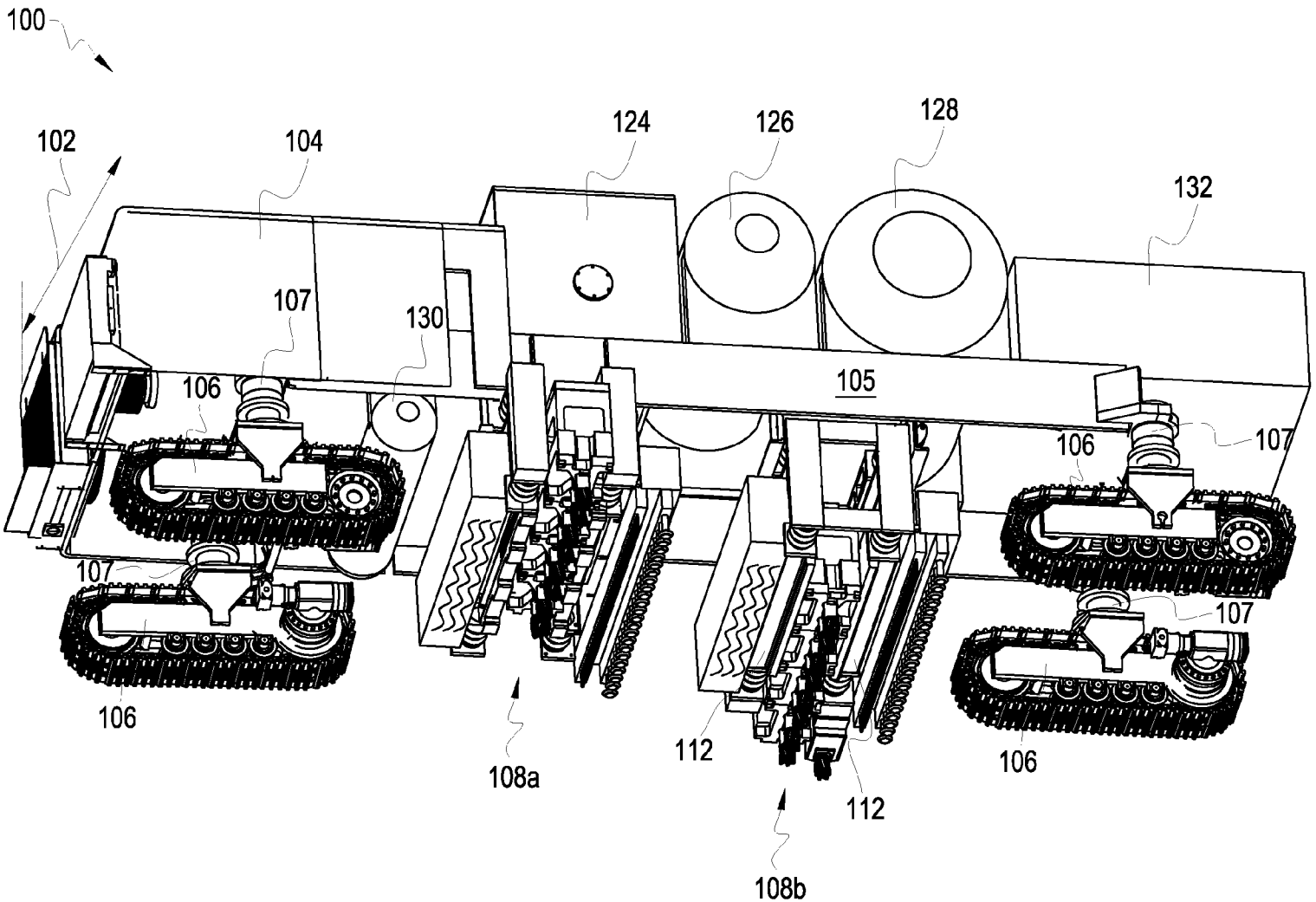
FIG. 1 is a perspective view illustrating an embodiment of a pavement recycling machine.
Figure 2:
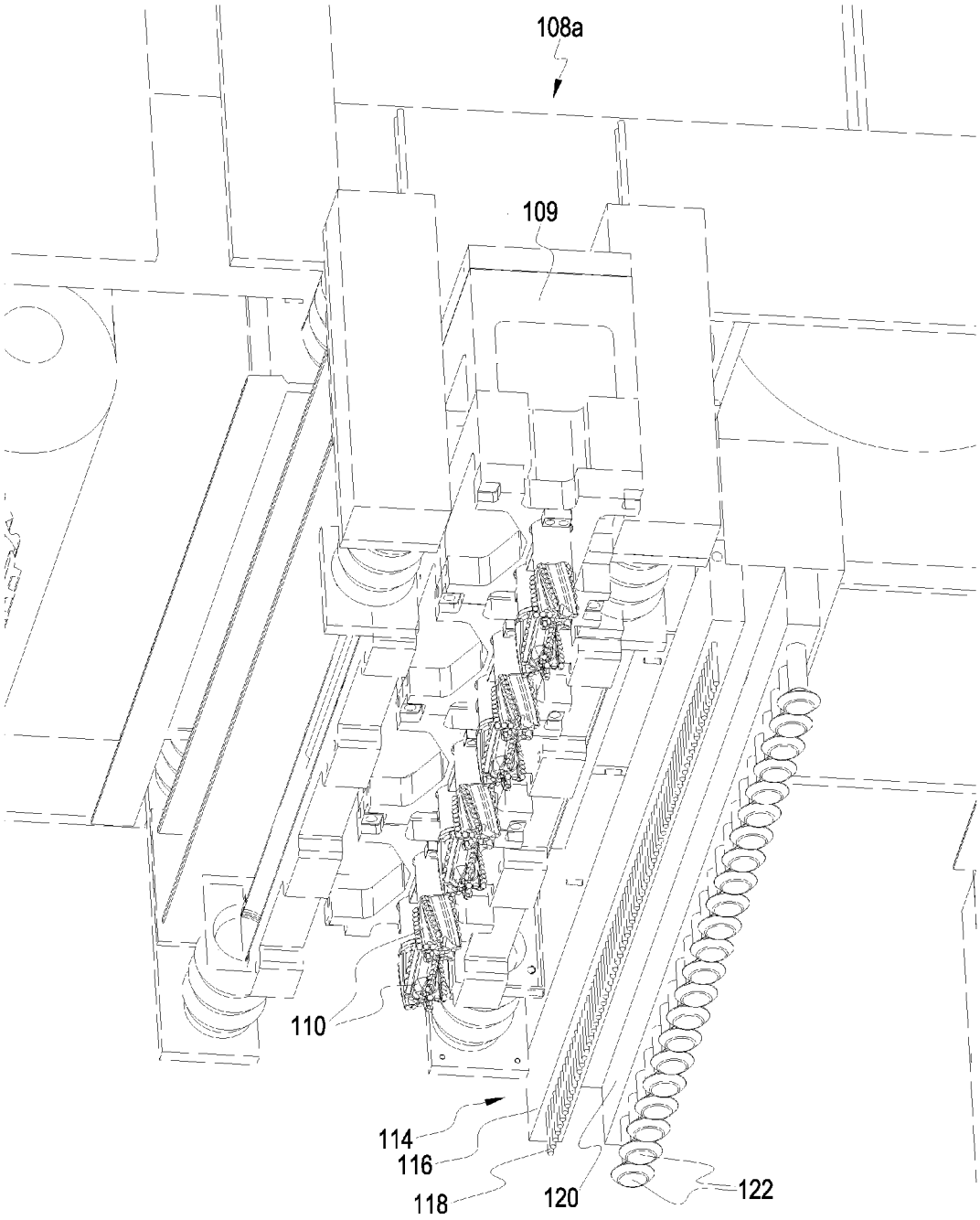
FIG. 2 is a perspective view of an embodiment of a support assembly comprising a bank of pavement degradation tools.

Referring to FIGS. 1 and 2, in selected embodiments, a pavement recycling machine 100 may be adapted to degrade and recycle a section of pavement substantially wider than the machine's width 102. The pavement recycling machine 100 may include a shroud 104, covering various internal components of the pavement recycling machine 100, a frame 105, and a translation mechanism 106 such as tracks, wheels, or the like, to translate or move the machine 100, such translation mechanisms being well known to those skilled in the art. The pavement recycling machine 100 may also include means 107 for adjusting the elevation and slope of the frame 105 relative to the translation mechanism 106 to adjust for varying elevations, slopes, and contours of the underlying road surface.

In selected embodiments, to facilitate degradation of a swath of pavement wider than the pavement recycling machine 100, the recycling machine 100 may include two or more support assemblies 108*a*, 108*b* that are capable of extending beyond the outer edge of the pavement recycling machine 100. Because the support assemblies 108*a*, 108*b* may be as wide as the vehicle itself, the extended support assemblies 108*a*, 108*b* may sweep over a width approximately twice the vehicle width 102. These assemblies 108*a*, 108*b* may include banks 109 of pavement degradation tools 110 that rotate about an axis substantially normal to a plane defined by a paved surface. Each of these pavement degradation tools 110 may be used to degrade a paved surface in a direction substantially normal to their axes of rotation.

To extend the support assemblies 108*a*, 108*b* beyond the outer edge of the pavement recycling machine 100, each of the support assemblies 108*a*, 108*b* may include actuators 112, such as hydraulic cylinders, pneumatic cylinders, or other mechanical devices known to those of skill in the art, to move the assemblies 108*a*, 108*b* to each side of the machine 100. Each support assembly 108*a*, 108*b* may also include a rake 114 to level, smooth, and mix pavement aggregates, including new aggregates and reclaimed aggregates generated by the pavement degradation tools 110. As illustrated, a rake 114 may include a housing 116 comprising multiple injectors 118 extending therefrom. In selected embodiments, each of the injectors 118 may be independently extended and retracted relative to the housing 116. This feature may allow selected injectors to be retracted to avoid obstacles such as manholes, grates, or other obstacles in the roadway.

In certain embodiments, each of the injectors 118 may be hollow to accommodate a flow of pavement rejuvenation materials for deposit on a road surface. Pavement rejuvenation materials may include, for example, asphalt, bitumen, tar, oil, water, combinations thereof, or other suitable materials, resins, and binding agents. These rejuvenation materials may be mixed with various aggregates, including new aggregates and reclaimed aggregates generated by the pavement degradation tools 110. The resulting mixture may then be smoothed and compacted to form a recycled road surface. In selected embodiments, the rake 114 may move side-to-side, front-to-back, in a circular pattern, vibrate, or the like to aid in mixing the resulting mixture of aggregates and rejuvenation materials. In certain embodiments, each support assembly 108*a*, 108*b* may include a bank 120 of one or more tampers 122 to compact the recycled road surface. Like the injectors 118, the tampers 122 may, in certain embodiments, be independently extendable and retractable relative to the bank 120.

Under the shroud 104, the pavement recycling machine 100 may include an engine and hydraulic pumps for powering the translation mechanism 106, the support assemblies 108*a*, 108*b*, the pavement degradation tools 110, or other components. Likewise, the pavement recycling machine 100 may include a tank 124 for storing hydraulic fluid, a fuel tank 126, a tank 128 for storing a first supply of rejuvenation materials such as asphalt, bitumen, oil, tar, or the like, another tank 130 for storing a second supply of rejuvenation material, such as a water tank, and a hopper 132 for storing aggregate such as gravel, rock, sand, pebbles, macadam, concrete, or the like.

Figure 3:
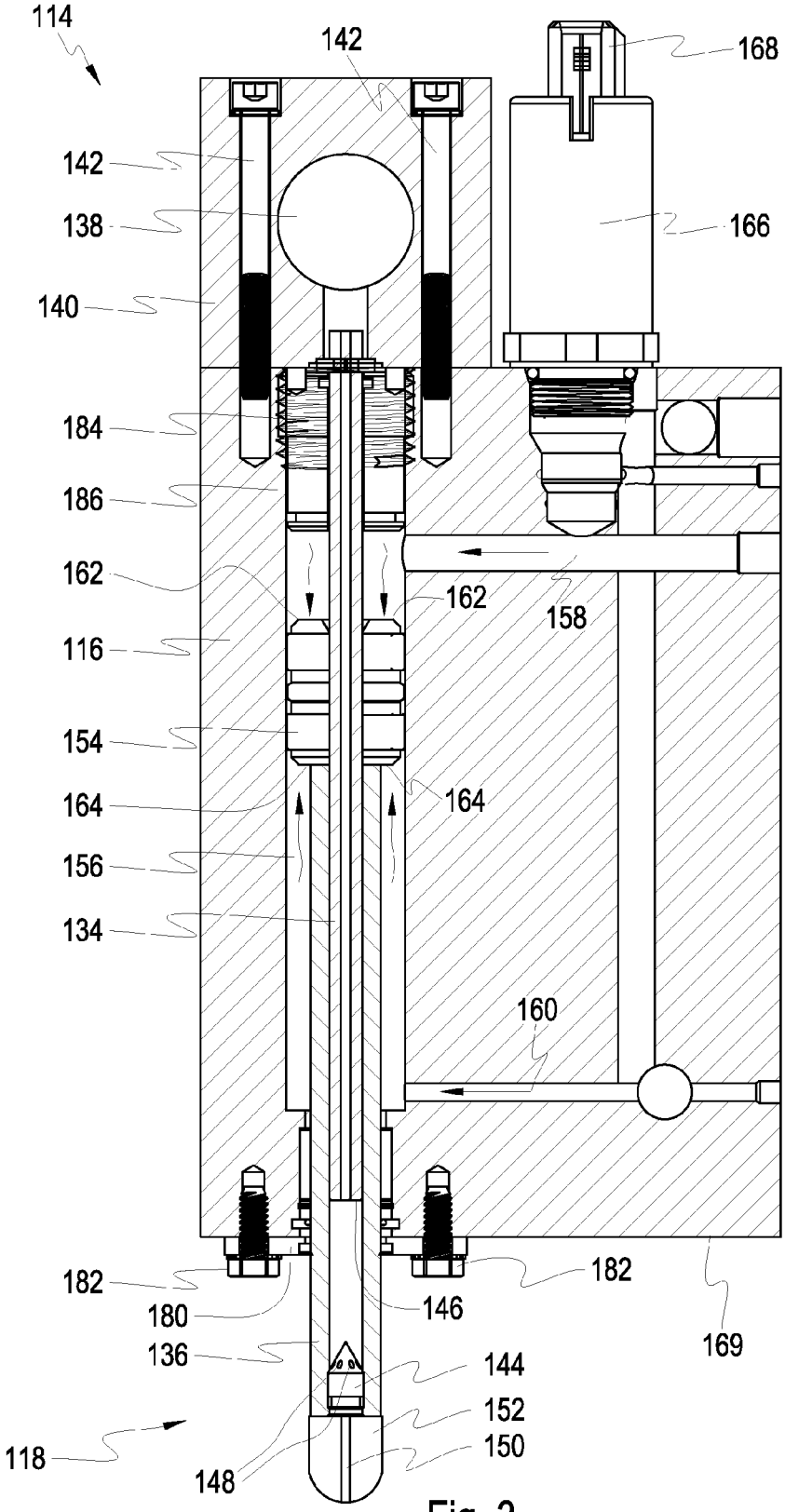
FIG. 3 is a cross-sectional view of an embodiment of an injector for depositing pavement rejuvenation materials on a road surface.

Referring to FIG. 3, as previously mentioned, a rake 114 may comprise a housing 116 and multiple injectors 118 extending therefrom. A duct 138 may travel through the housing 116 to provide a supply of rejuvenation materials under pressure to each of the injectors 118. In certain embodiments, the duct 138 may travel through a separate housing 140 which may be bolted or otherwise connected to the main housing 116 using connectors 142, such as bolts 142.

In certain embodiments, an injector 118 may comprise a first channel 134 in communication with the supply of pavement rejuvenation materials provided by the duct 138. The outside diameter of the first channel may slide inside a second channel 136 thereby transmitting the supply of pavement rejuvenation materials into the second channel 136. In certain embodiments, the first channel 134 may remain relatively fixed with respect to the housing 116, while the second channel 136 may extend and retract (downward in the illustrated embodiment) with respect to the first channel 134 and the housing 116. A seal may be provided between the first channel 134 and the second channel 136 to prevent leakage of rejuvenation materials where the two channels 134, 136 interface.

A blocking element 144 may be coupled to the second channel 136. In the illustrated embodiment, the blocking element 144 has a conical shape although other shapes are possible and within the scope of the invention. As will become apparent in the description associated with FIG. 4, as the second channel 136 slides upward with respect to the first channel 134, the blocking element 144 contacts a seat 146 coupled to the first channel 134. The blocking element 144 and the seat 146 together form a valve 144, 146. Upon contacting the seat 146, the blocking element 144 seals off the first channel 134, thereby cutting off the flow of rejuvenation materials. Thus, when the injector 118 is retracted (i.e., slid upward), the flow of pavement rejuvenation materials is cut off. Conversely, when the injector 118 is extended, the valve 144, 146 opens and re-initiates the flow of rejuvenation materials. As shown, the blocking element 144 may include one or more passageways 148 to accommodate a flow of pavement rejuvenation materials when the valve 144, 146 is open. These passageways 148 may connect to an opening 150 for depositing the pavement rejuvenation materials on a road surface.

The hardened tip 152 may be coupled to the second channel 136 to provide added durability to the injector 118 and to resist the abrasive effects of pavement materials (i.e., rock, gravel, concrete, etc.) on the road surface. For example, in certain embodiments, the hardened tip 152 may be coated with diamond, boron nitride, a cemented metal carbide, or combinations mixtures, or alloys thereof, to provide added durability. A hardened tip may also reduce wear and/or corrosion.

In some embodiments of the present invention, a nozzle may be fitted within the opening 150 for depositing the pavement rejuvenation materials on a road surface. The nozzle may increase the pressure exerted on the pavement rejuvenation materials as they exit the opening 150. A nozzle 2000 (see FIG. 5) may also increase the temperature and pressure of the pavement rejuvenation material immediately before the rejuvenation material exits the opening 150, which may allow rejuvenation material to be heated to a higher temperature before they are deposited. The nozzle may also comprise a particular pattern which may help deposit the rejuvenation material in a specific desired manner. Individual injectors 118 may comprise a nozzle with a different pattern such that the injectors near the end of the swath of pavement may deposit the rejuvenation material differently than the injectors that are positioned near the middle of the same swath of pavement.

To extend and retract the injector 118, a piston 154 may be coupled to the second channel 136 and slide with respect to the first channel 134. The first channel 134 may slide through a bore in the piston 154. The housing 116 may comprise a chamber 156 to accommodate the travel of the piston 154. In certain embodiments, the piston 154 may be driven by hydraulic fluid supplied under pressure to the chamber 156, although it is contemplated that pressurized air or other fluids could also be used. In one embodiment, hydraulic fluid may be supplied to the chamber 156 through a pair of passageways 158, 160 in the housing 116. Hydraulic fluid supplied under pressure through a first passageway 158 may exert force on a first surface 162 of the piston 154, while hydraulic fluid supplied under pressure through a second passageway 160 may exert force on a second surface 164 of the piston 154. Because the second channel 136 may connect to one end of the piston 154, the area of the first surface 162 may be larger than the area of the second surface 164. Thus, applying equal hydraulic pressure to each of the first and second surfaces 162, 164, the piston 154 will be urged downward due to the greater area of the surface 162.

In order to extend and retract the injector 118, in selected embodiments, hydraulic pressure may be supplied continuously over time through the passageway 160. Conversely, a roughly equal hydraulic pressure may be selectively turned on or off through the passageway 158 by way of a valve 166. Thus, when hydraulic pressure through the passageway 158 is turned off, continuous pressure supplied through the passageway 160 urges the piston 154 upward. As the piston 154 travels upward, hydraulic fluid above the piston 154 and inside the passageway 158 may flow into a hydraulic fluid reservoir or tank (not shown). On the other hand, when hydraulic pressure through the passageway 158 is turned on, this hydraulic pressure overcomes the hydraulic pressure supplied through the passageway 160 (due to the difference in the piston surface areas 162, 164), thereby urging the piston 154 downward and extending the injector 118 relative to the housing 116. Although the present invention is not limited by any set pressure or range of pressures, in selected embodiments, the piston 154 may be actuated by fifty to one hundred and fifty PSI of hydraulic pressure. In selected embodiments, the valve 166 may be solenoid driven, be screwed into the housing 116, and be actuated by way of an electrical connection 168.

At or near the bottom surface 169 of the housing 116, one or more bushings may be used to act as a bearing between the second channel 136 and the housing 116, and one or more seals may be used to contain the hydraulic pressure within the chamber 156 and to prevent contamination from entering the chamber 156. The bushings and/or seals may be retained and accessed by way of a plate 180 coupled to the housing 116 by way of one or more connectors 182, such as bolts 182. Similarly, a retainer 184 may be positioned at or near the top of the chamber 156 and may be used to retain the first channel 134 in a substantially fixed position with respect to the housing 116. In selected embodiments, the retainer 184 may be screwed into the housing 116 and may include a clip to engage a slot milled in the first channel 134. The retainer 184 may also include a stopper 186 to stop the upward travel of the piston 154. In certain embodiments, the retainer 184 may be accessed by removing the duct housing 140 from the main housing 116.

Figure 4:
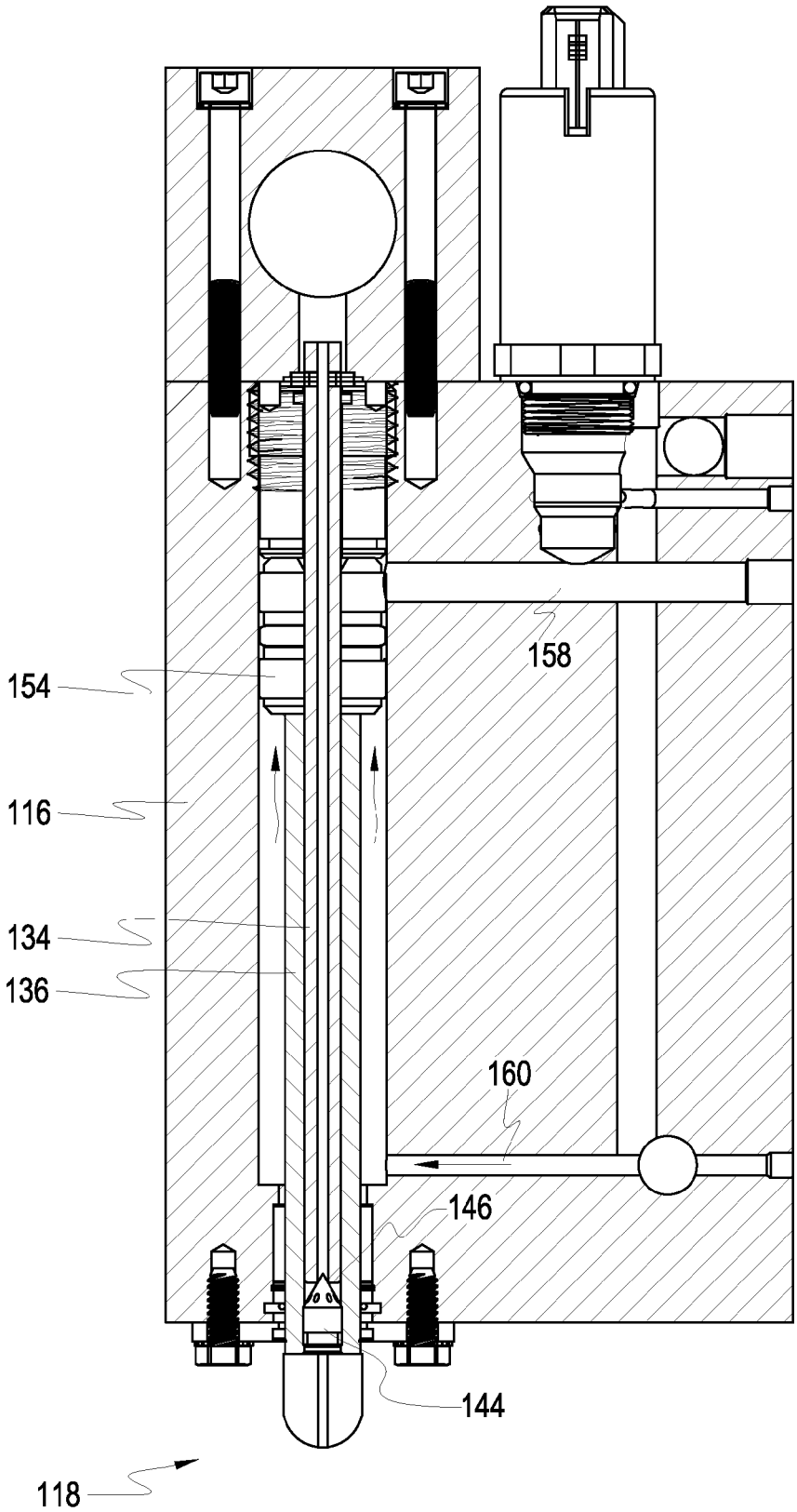
FIG. 4 is a cross-sectional view of the injector of FIG. 3 in a retracted position.

Referring to FIG. 4, upon turning off the hydraulic pressure in the passageway 158, hydraulic pressure through the passageway 160 urges the piston 154 and the second channel 136 upward, thereby retracting the injector 118 relative to the housing 116. As the injector 118 moves upward, the blocking element 144 (in this embodiment a conically shaped blocking element) contacts the seat 146, thereby blocking the first channel 134. This cuts off the flow of pavement rejuvenation materials flowing through the first and second channels 134, 136.

Figure 5:
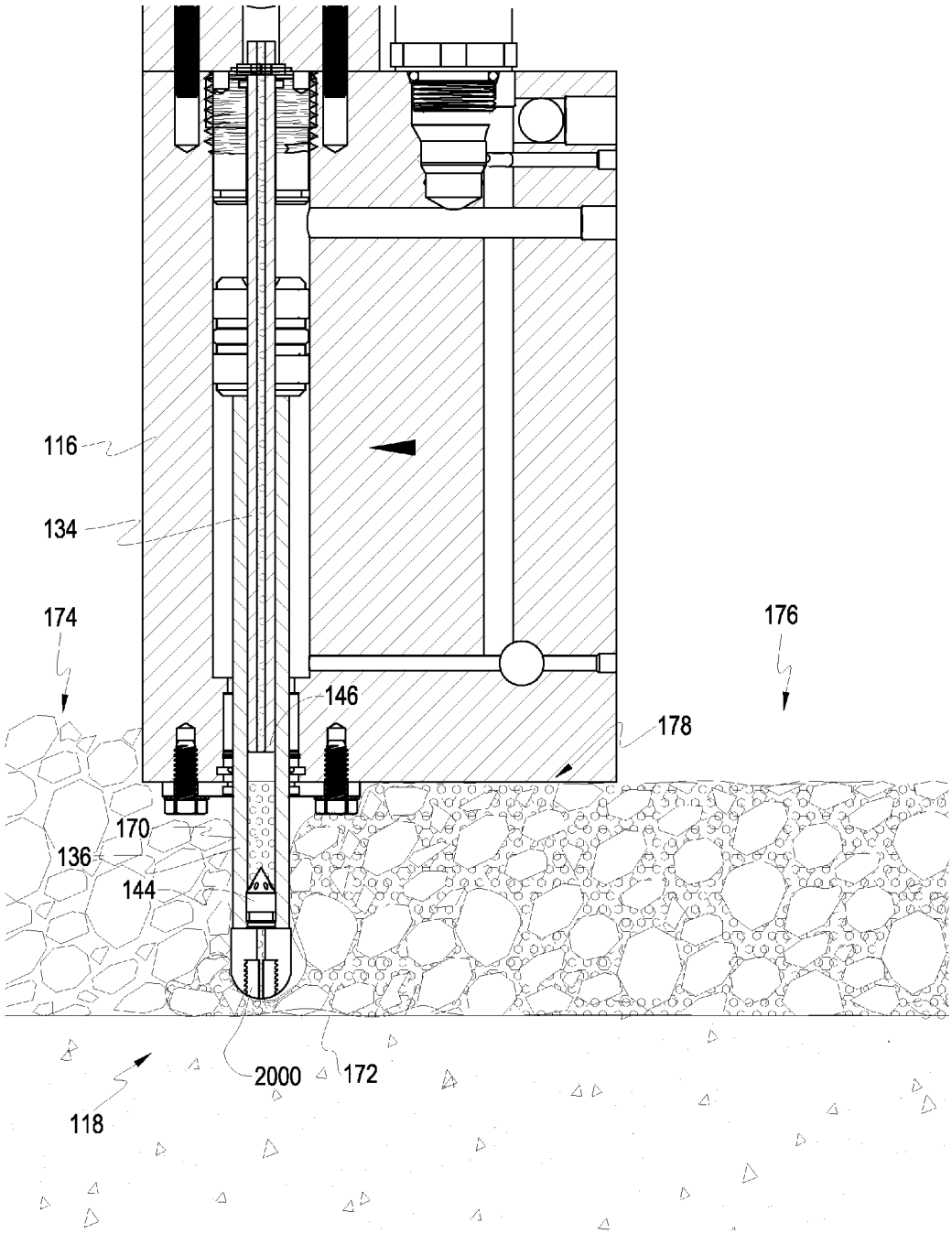
FIG. 5 is a cross-sectional view of an embodiment of an injector depositing pavement rejuvenation materials into pavement aggregates.

Referring to FIG. 5, as previously mentioned, a valve 144, 146 opens upon extending an injector 118 relative to the housing 116. This allows rejuvenation materials 170 to flow through the first and second channels 134, 136 onto a road surface 172. As previously explained with respect to FIG. 3, rejuvenation materials 170 may be supplied under pressure by way of a duct 138 communicating with the first and second channels 134, 136. Once expelled from the injector 118, the rejuvenation materials 170 may be mixed with aggregates 174, which may include reclaimed pavement aggregates generated by the pavement degradation tools 110 (referring back to FIGS. 1 and 2), new aggregates, or combinations thereof. The resulting mixture 176 may then be smoothed and compacted to form a new or recycled pavement surface. In certain embodiments, a bottom surface 178 of the housing 116 may be used as a screed to smooth and/or compact the resulting pavement mixture 176.

In selected embodiments, the rejuvenation materials 170 may be discharged from the injector 118 in a "foamed" state. For example, in certain embodiments, a mixture of water and hot bitumen may be discharged from the injector 118. The pressure drop that occurs upon discharge may cause the mixture of hot bitumen and water to spontaneously transform into foam. This "foamed bitumen" has a significantly reduced viscosity compared to unfoamed bitumen, which allows the bitumen to be more easily mixed with aggregates 174. The foamed bitumen may also expand to saturate and permeate the aggregates 174. The resulting mixture, or "foamed asphalt," may provide several significant advantages when performing in place, or in situ, pavement recycling. For example, it is reported that foamed bitumen increases the shear strength of the resulting paved surface, while reducing its susceptibility to moisture. The strength of foamed asphalt may approach that of cemented materials, while being more flexible and fatigue resistant than cemented materials.

Furthermore, when performing cold or warm mix processes, this foaming technique may allow bitumen (or other rejuvenation materials) to be mixed with a wider variety of aggregates. Foamed asphalt may also require less binder and water than other methods of cold mixing, which reduces binder and transportation costs. Foamed asphalt can also be compacted and used immediately upon deposit to the road surface, thereby saving time and money. Furthermore, this technique conserves energy because only the bitumen requires heating; the aggregates may be mixed while cold or damp. In the preferred embodiment, the asphalt is heated prior to adding the pavement rejuvenation material within 100 to 275 degrees Fahrenheit. Energy may still be conserved in such embodiments when compared with typical hot-in-place recycling methods.

Other advantages include reported environmental benefits. The foaming technique reduces environmental harm that may occur from the evaporation of volatiles from the asphalt mix because curing generally does not release volatiles into the environment. According to some reports, foamed asphalt may also be stockpiled without binder runoff or leeching. Foamed asphalt may be deposited in adverse weather conditions, such as cold temperatures or light rain, without changing the characteristics or quality of the material.

Figure 6:
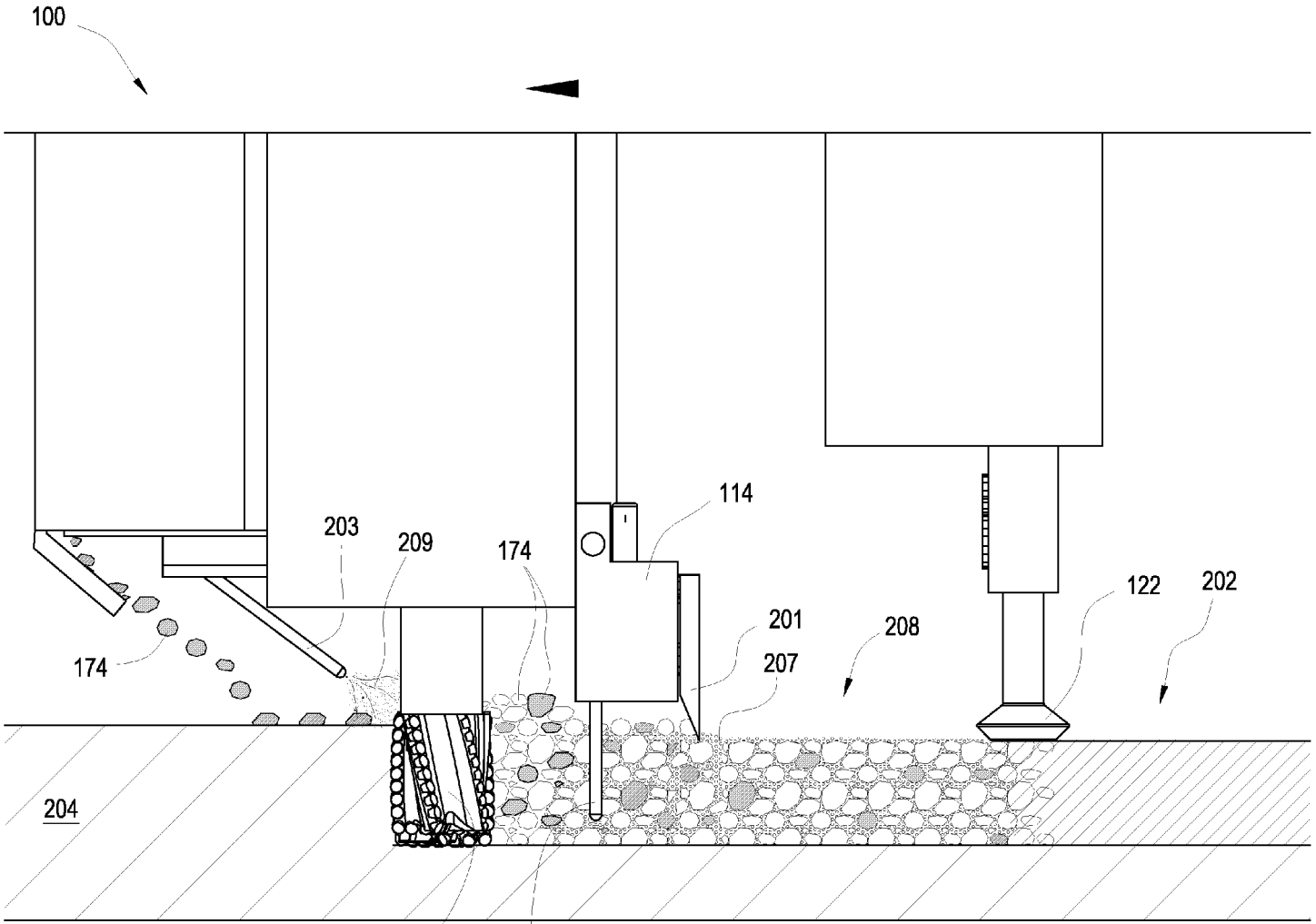
FIG. 6 is a cross-sectional view of an embodiment of a pavement recycling machine recycling a road surface.

Referring to FIG. 6, as previously mentioned, a pavement recycling machine 100 may progressively degrade an asphalt surface 204 into a layer of pavement aggregate 174, add pavement rejuvenation materials 170 to the layer of pavement aggregate 174, level the surface of the pavement rejuvenation material and aggregate mixture 208 and compact the mixture 208 into finished asphalt 202.

As the pavement recycling machine 100 moves forward in the direction indicated by the arrow, new aggregate 174 may be deposited on the asphalt surface 204. The new aggregate 174 may be added to compensate for any crushing or deterioration of old aggregate 174 during the degradation of the asphalt surface 204 in addition to changes in the old aggregate 174 that may have occurred over the life of the asphalt surface 204. A rejuvenating fog 209 may be deposited on the new aggregate 174 from a fogging nozzle 203 prior to and/or during degradation of the asphalt surface 204. In some embodiments, rejuvenating fog 209 may be deposited on both new and old aggregate 174 after the asphalt surface 204 is degraded. The rejuvenating fog 209 may comprise a mixture of maltenes and serve a number of purposes. For example, the rejuvenating fog 209 may wet the aggregate 174 to allow better adhesion to additional rejuvenation material 207 that may be added later, act as a dust suppressant, and restore maltene content in the original aggregate 174 that may have been lost due to wear and tear on the road.

The original asphalt surface 204 may be abraded by pavement degradation tools 110. The pavement degradation tools may comprise diamond. After passing through the pavement degradation tools 110 the original asphalt surface 204 may become a layer comprising a mixture of recovered and new aggregate 174. A rejuvenating fog 209 may also be applied to the newly recovered aggregate 174 after passing through the pavement degradation tools 110.

The injector 118 of rake 114 may comprise at least one channel 134, 136 and an opening 150. One feature of the present invention is that pavement rejuvenating materials 170 are added to the layer of aggregate 174 below the surface of the layer. The injector 118 may comprise a special diamond tip that allows it to drag against the bottom of the layer of aggregate 174 while injecting rejuvenation materials 170 into the layer.

Preferably the rejuvenation materials 170 foam under atmospheric pressure. This would allow the rejuvenation materials 170 to foam on injection into the layer of pavement aggregate 174 and coat both the new and recovered aggregate 174 as foamed material 170 rises to the surface of the layer. Preferably the rejuvenation materials 170 may comprise a binder such as bitumen mixed with a foaming agent, such as water. In some embodiments the rejuvenation materials may comprise a synthetic zeolite such as Aspha-Min® that can store water and thermally release it into the binder when heated. In other embodiments a wax such as Sasobit® may be incorporated into the rejuvenation materials 170 to lower the viscosity of the rejuvenation material and aggregate mixture. At lower temperatures below its melting point the wax may freeze and afford additional mechanical strength to the aggregate and pavement rejuvenation material mixture 208.

A screed 201 may be used to level the mixture 208 and prepare it for compaction by a tamper 122 or other discrete elements such as vibratory rollers, and/or vibratory sleds. Once compacted, the new pavement 202 may be finished and sealed to provide protection against the elements, and tests on the pavement 202 may be performed to collect feedback on the recycling process.

Figure 7:
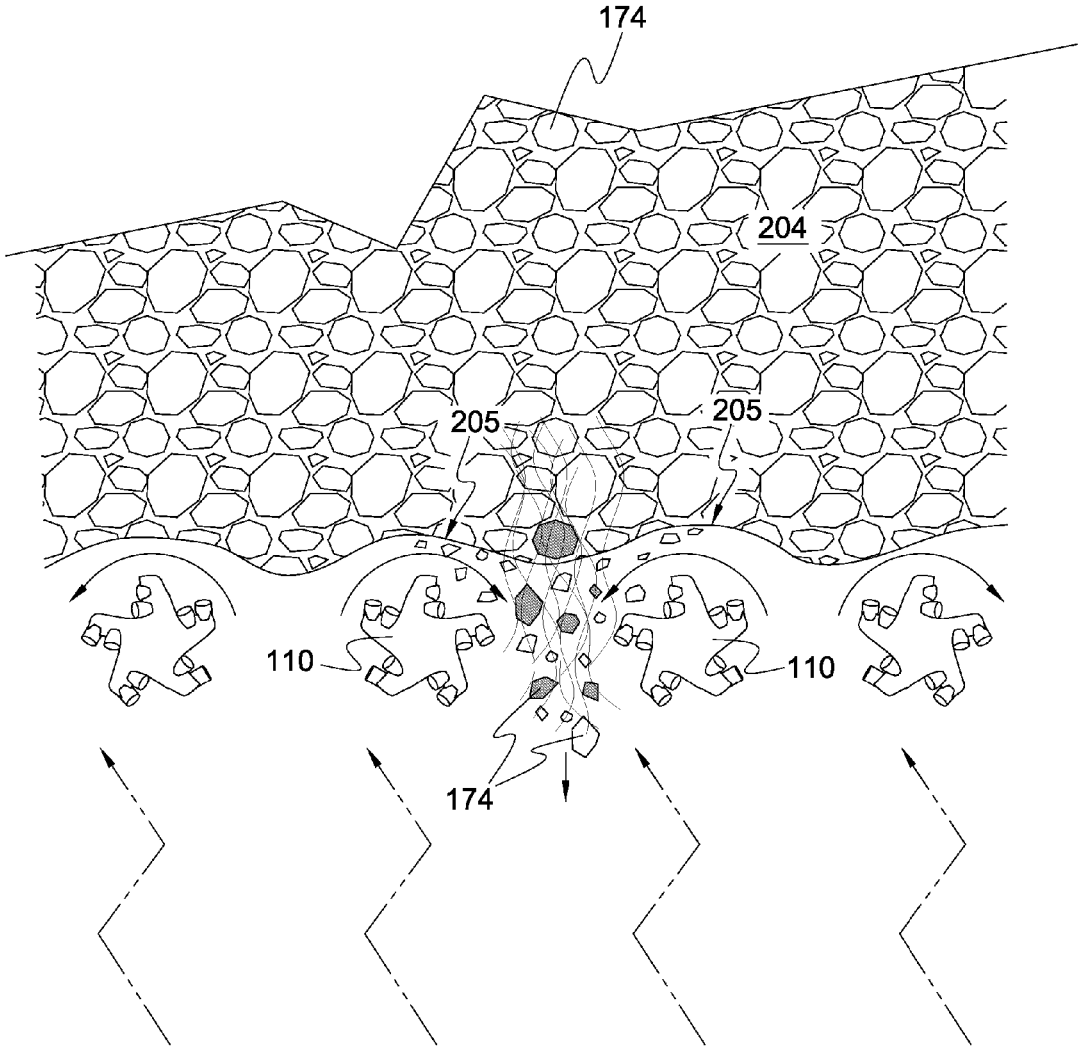
FIG. 7 is a top view of an embodiment of pavement degradation tools on a recycling machine.

Referring now to FIG. 7, the pavement degradation tools 110, may be spin in opposite directions helping incorporate new aggregate with aggregate recovered from the degradation of the original pavement surface 204. The pavement degradation tools 110 may move side to side as the pavement recycling machine moves forward into the original pavement surface 204. Each tool 110 may also be able to individually move up and down to avoid obstacles such as manholes.

Figure 8:
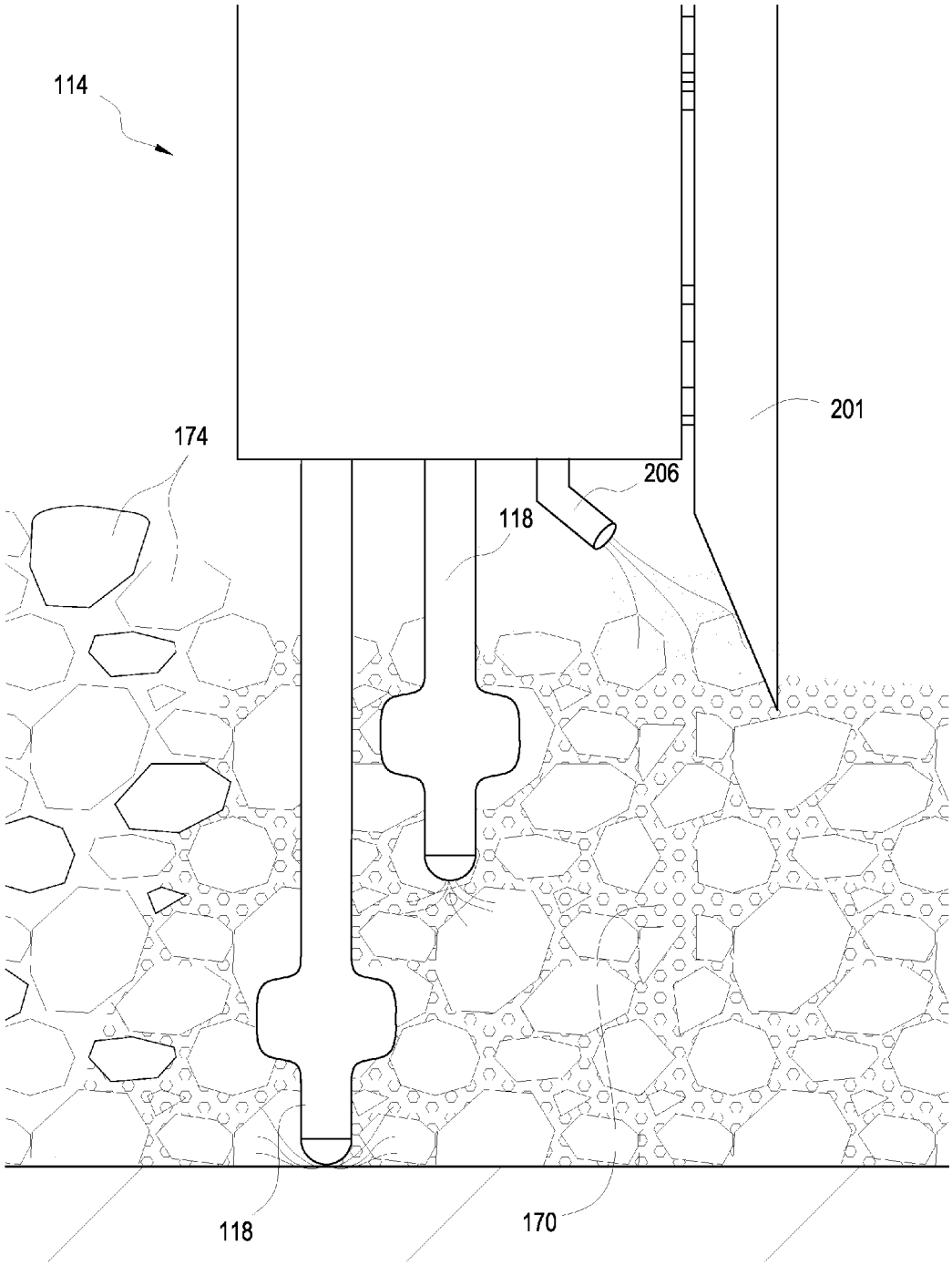
FIG. 8 is a cross-sectional view of an embodiment of injectors depositing pavement rejuvenation materials into pavement aggregates.

Referring now to FIG. 8, as previously mentioned, injectors 118 from the rake 114 may extend to varying depths in the layer of aggregate 174. At different depths, the pavement rejuvenation materials 170 may flow out and coat the aggregate 174 more thoroughly. The injectors 118 may be raised and lowered as specific layers of aggregate 174 may require. A nozzle 206 may fog or spray fresh rejuvenation materials 170 onto the surface of the layer of aggregate 174 to ensure adequate surface coating. In some embodiments the injectors 118 may comprise sensors that detect the amount of rejuvenation materials 170 being dispersed into the aggregate 174 and appropriate settings on the height and flow of the injectors 118 and nozzle 206 may be adjusted accordingly to obtain maximum efficiency.

Figure 9:
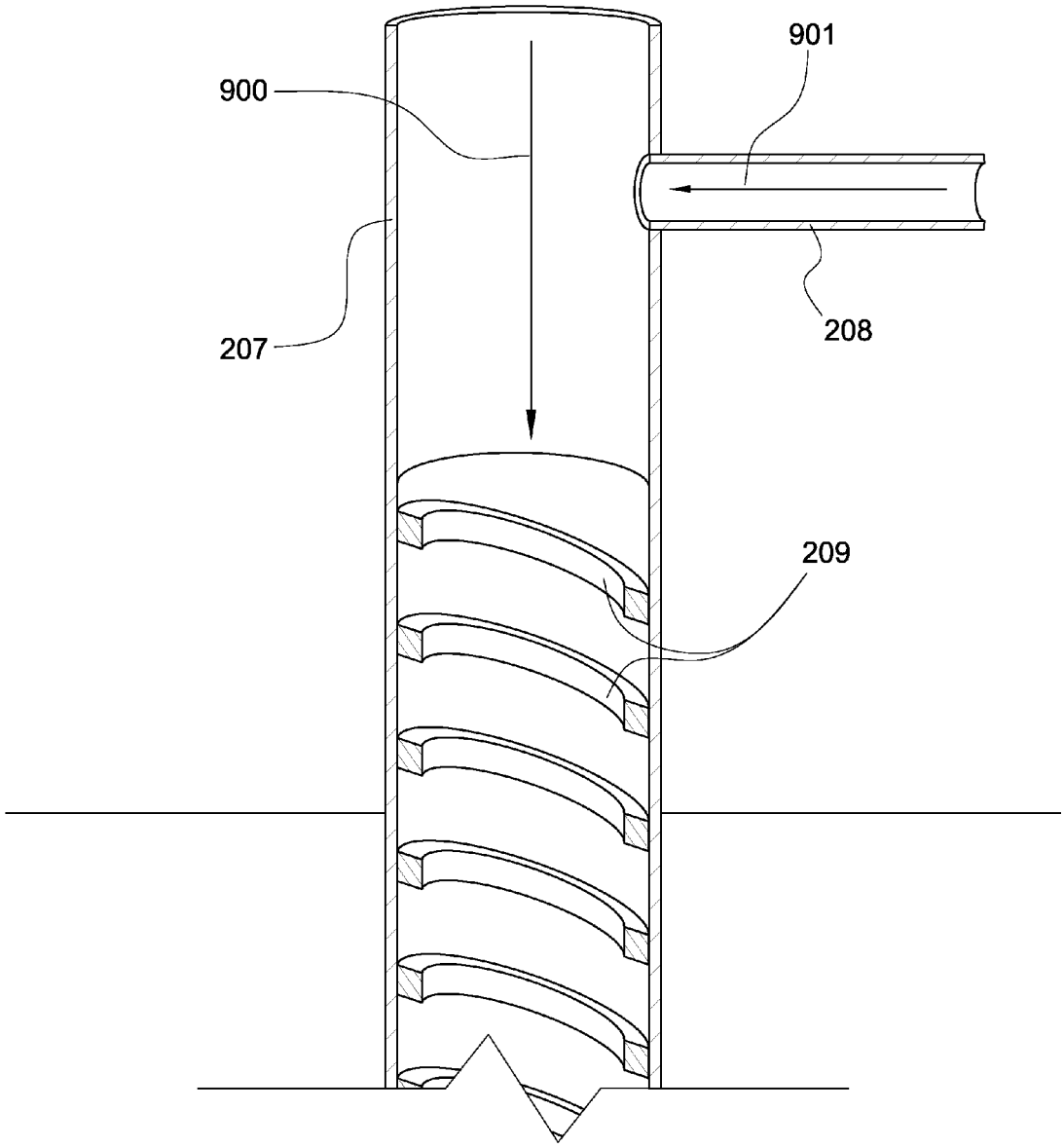
FIG. 9 is a cross-sectional view of an apparatus for mixing a first pavement rejuvenation material with a second pavement rejuvenation material.

Referring now to FIG. 9, as previously mentioned, the rejuvenating material 170 may be mixed with a second rejuvenating material 170 from another source to produce a foamed asphalt or another resultant rejuvenating substance. The first rejuvenating material 170 may flow through a mixing chamber 207 in the direction indicated by arrow 900 as the second rejuvenating material 170 flows through a conduit 208 into the mixing chamber 207 as indicated by arrow 901. The conduit 208 may be perpendicular to the mixing chamber in order to provide optimal mixing of the rejuvenating materials 170. In some embodiments the first rejuvenating material 170 may be bitumen or a similar substance and the second rejuvenating material 170 may be water, a liquid, a gas, polymers, clay, wax, oil based substance, zeolites or combinations thereof. The mixing chamber 207 preferably comprises in-line agitating elements 209 to facilitate a more thorough mixing of the rejuvenating materials 170. The in-line agitating elements 209 may comprise a variety of geometries designed to further agitate the materials together. The geometries may comprise a surface substantially perpendicular, diagonal or parallel to the flow of materials. There may be one in-line agitating element disposed within the member or there may be a plurality of elements 209. The mixing chamber 207 may be incorporated into one of the channels 134, 136 of the injectors 118 in the rake 114 of previous figures or the mixing chamber 207 may be located in the path between the supplies of rejuvenation material and the injectors 118. Preferably the mixing of rejuvenating materials 170 takes place under high pressures.

Figure 10:
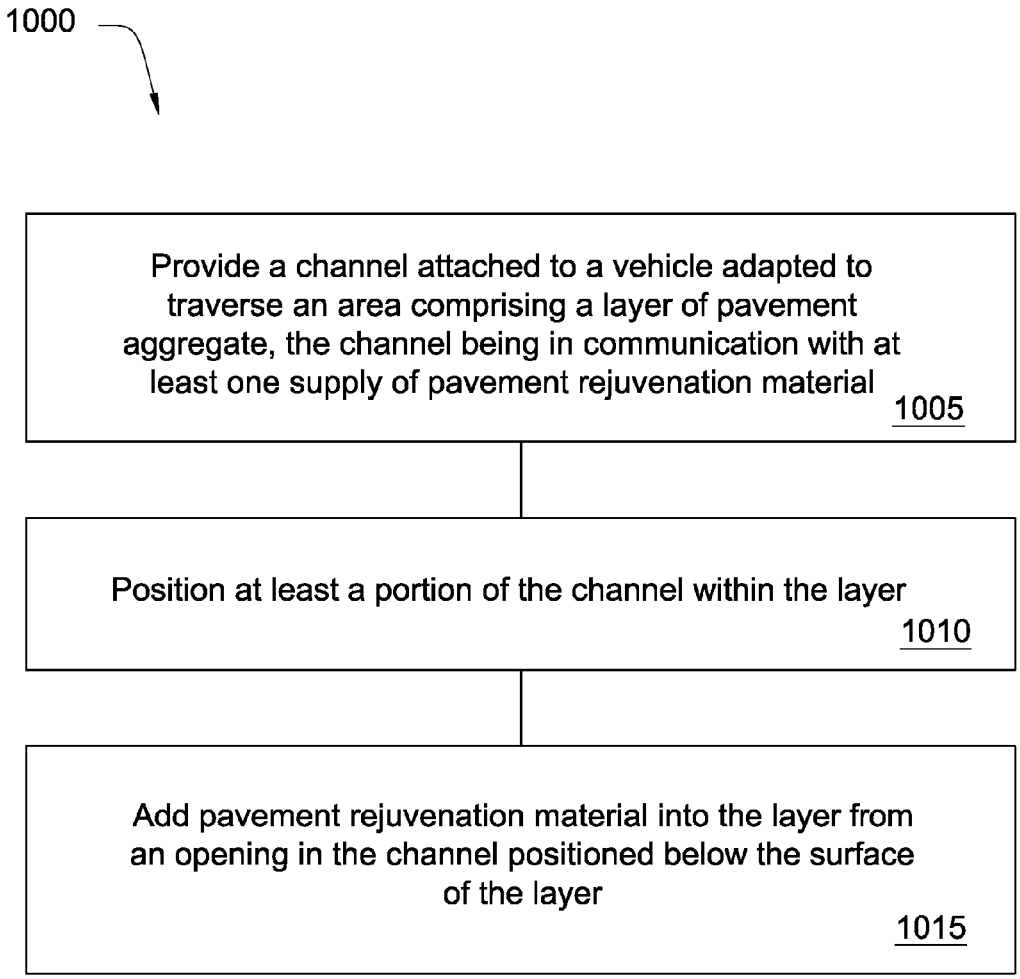
FIG. 10 is a flowchart illustrating an embodiment of a method of recycling pavement.

Referring now to FIG. 10, as previously mentioned, the asphalt recycling process described in the previous figures may be characterized by a method 1000 for recycling a roadway. The method 1000 includes the step of providing 1005 a channel attached to a vehicle adapted to traverse an area comprising a layer of pavement aggregate, the channel being in communication with at least one supply of pavement rejuvenation material. The method further includes the steps of positioning 1010 at least a portion of the channel within the layer and adding 1015 rejuvenation material into the layer from an opening in the channel positioned below the surface of the layer. The channel may be incorporated into the injector of a rake in a pavement recycling machine.

Figure 11:
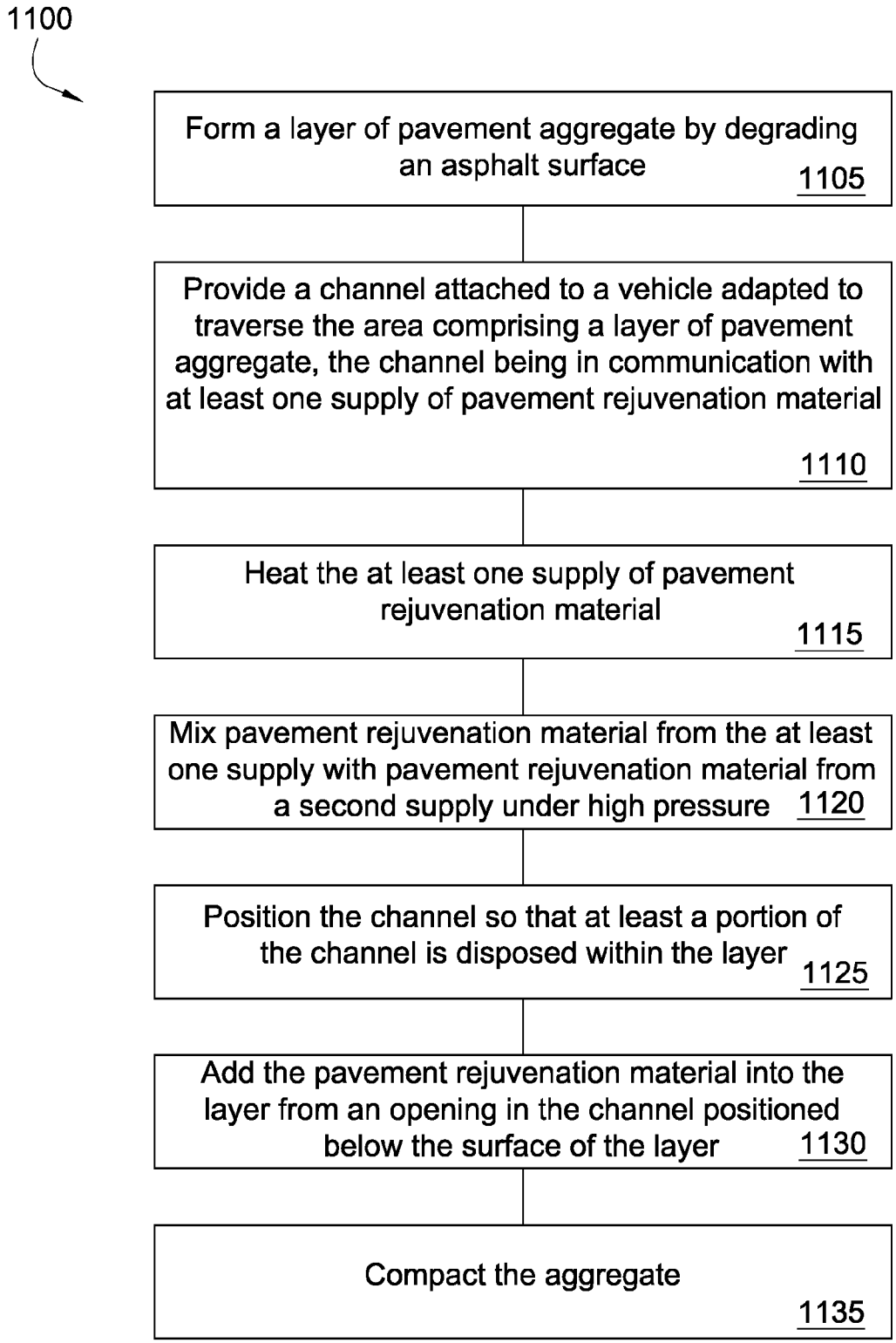
FIG. 11 is a flowchart illustrating a more detailed embodiment of a method of recycling pavement.

Referring now to FIG. 11, as previously mentioned, a more detailed method 1100 of recycling pavement is shown. The method 1100 includes the steps of forming 1105 a layer of pavement aggregate by degrading an asphalt surface and providing 1110 a channel attached to a vehicle adapted to traverse an area comprising the layer of pavement aggregate. The channel is in communication with at least one supply of pavement rejuvenation material, such as bitumen.

The method 1100 further includes the step of heating 1115 the at least one supply of pavement rejuvenation material and mixing 1120 the pavement rejuvenation material from the at least one supply with pavement rejuvenation material from a second supply under high pressure. The pavement rejuvenation material from the second supply may comprise water, a liquid, a gas, polymers, clay, wax, oil based substance, zeolites or combinations thereof. The pavement rejuvenation materials may foam under normal atmospheric pressures, so the high pressure mixing may prevent the pavement rejuvenation materials from foaming in the channel.

The channel is then positioned 1125 so that at least a portion of the channel is disposed within the layer and the pavement rejuvenation material is added 1130 into the layer from an opening in the channel positioned below the surface of the layer. The rejuvenation materials may foam as they exit the opening, lowering their overall viscosity and promoting more complete adhesion to the aggregate as the pavement rejuvenation material rises to the surface of the layer.

Once the pavement rejuvenation material is added 1130 into the layer and adheres adequately to the aggregate, the aggregate is compacted 1135 to complete the main process. Final steps may also be taken such as sealing and finishing the roadway and collecting data on the finished roadway.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

Whereas the present invention has been described in particular relation to the drawings attached hereto, it should be understood that other and further modifications apart from those shown or suggested herein, may be made within the scope and spirit of the present invention.

What is claimed is:

1. A method, comprising:

forming a layer of pavement aggregate by degrading pavement with a plurality of degradation elements attached to an underside of a vehicle and adapted for independent movement of each other;

the degradation elements rotate about an axis substantially normal to a paved surface;

providing a channel attached to the vehicle adapted to traverse an area comprising a layer of pavement aggregate, the channel being in communication with at least one supply of pavement rejuvenation material;

positioning the channel so that at least a portion of the channel is disposed within the layer; and adding the pavement rejuvenation material into the layer from an opening in the channel positioned below the surface of the layer.

2. The method of claim 1, wherein the method further comprises a step of mixing at least some pavement rejuvenation material from the at least one supply with at least some pavement rejuvenation material from a second supply of pavement rejuvenation material to form a resultant rejuvenation material.

3. The method of claim 2, wherein the resultant rejuvenation material foams under atmospheric pressure.

4. The method of claim 3, wherein the step of mixing at least some of the pavement rejuvenation material from a first supply with at least some pavement rejuvenation materials of a second supply occurs under a pressure high enough to keep the resultant rejuvenation material from foaming.

5. The method of claim 3, wherein the resultant rejuvenation material foams as it exits the opening.

6. The method of claim 3, wherein the resultant rejuvenation material has characteristic of having a foaming half life of 5-60 seconds.

7. The method of claim 2, wherein the step of mixing at least some of the pavement rejuvenation material with at least some of a second supply of rejuvenation material occurs within the channel.

8. The method of claim 2, wherein the second supply of pavement rejuvenation material comprises water, a liquid, a gas, polymers, clay, wax, oil based substance, a zeolite, or combinations thereof.

9. The method of claim 8, wherein the pavement rejuvenation material from the first or second supply is heated.

10. The method of claim 1, wherein the opening of the channel is protected by a superhard material.

11. The method of claim 1, wherein the method further comprises a step of spraying the surface of the layer with pavement rejuvenation material from a sprayer attached to the vehicle.

12. The method of claim 11, wherein the sprayed pavement rejuvenation material foams under atmospheric pressure.

13. The methods of claim 1, wherein the channel is adapted to vibrate, rotate, shake, move, or oscillate.

14. The method of claim 1, wherein the pavement rejuvenation material bonds the layer of pavement aggregate to a second layer of the area.

15. The method of claim 14, wherein the channel contact the second layer.

16. The method of claim 1, wherein the layer of pavement aggregate is intended to contribute to a wearing surface, a road base, a road sub-base, a drive way, a parking lot or combinations thereof.

17. The method of claim 1, wherein the method further comprises a step of forming the layer of pavement aggregate by degrading a paved surface of the area.

18. The method of claim 1, wherein the method further comprises a step of compacting the aggregate after the pavement rejuvenation material has been added.

19. The method of claim 1, wherein a sensor is adapted to monitor a characteristic within the channel.

20. The method of claim 19, wherein the characteristic is selected from the group consisting of temperature, pressure, flow rate, density of material, volume of material, viscosity of the material, vibration or combinations thereof.

21. The method of claim 1, wherein the opening comprises a nozzle.

22. The method of claim 1, wherein the method further includes a step of heating the aggregate prior to adding the pavement rejuvenation material to 100 to 275 degrees Fahrenheit.

* * * * *